US006763856B2

(12) United States Patent
Healy

(10) Patent No.: US 6,763,856 B2
(45) Date of Patent: Jul. 20, 2004

(54) VAPOR SPACE PRESSURE CONTROL SYSTEM FOR UNDERGROUND GASOLINE STORAGE TANK

(75) Inventor: James W. Healy, Hollis, NH (US)

(73) Assignee: Healy Systems, Inc., Hudson, NH (US)

( * ) Notice: Subject to any disclaimer, the term of this patent is extended or adjusted under 35 U.S.C. 154(b) by 0 days.

(21) Appl. No.: 10/340,951

(22) Filed: Jan. 13, 2003

(65) Prior Publication Data

US 2003/0131903 A1 Jul. 17, 2003

Related U.S. Application Data

(60) Provisional application No. 60/347,698, filed on Jan. 11, 2002, and provisional application No. 60/364,745, filed on Mar. 15, 2002.

(51) Int. Cl.[7] ..... B65B 1/04

(52) U.S. Cl. ..... 141/45; 141/59; 141/82

(58) Field of Search ..... 141/45, 98, 82, 141/59, 392, 286; 55/524, 527

(56) References Cited

U.S. PATENT DOCUMENTS

| | | | | | |
|---|---|---|---|---|---|
| 3,756,291 | A | * | 9/1973 | McGahey et al. | 141/45 |
| 3,800,510 | A | * | 4/1974 | Lamond | 96/6 |
| 3,815,327 | A | * | 6/1974 | Viland | 95/220 |
| 3,913,663 | A | * | 10/1975 | Hiller | 141/45 |
| 3,957,468 | A | * | 5/1976 | Voth et al. | 96/358 |
| 4,019,482 | A | * | 4/1977 | Pugliese | 123/591 |
| 4,131,141 | A | | 12/1978 | Weissenbach | |
| 5,305,807 | A | | 4/1994 | Healy | |
| 5,537,911 | A | | 7/1996 | Ohlrogge et al. | |
| 5,803,136 | A | | 9/1998 | Hartsell, Jr. | |
| 5,878,792 | A | * | 3/1999 | Pettazzoni et al. | 141/59 |
| 6,128,908 | A | | 10/2000 | Gustafson | |
| 6,302,164 | B1 | * | 10/2001 | Nitecki et al. | 141/45 |
| 6,478,849 | B1 | | 11/2002 | Taylor et al. | |

FOREIGN PATENT DOCUMENTS

| | | |
|---|---|---|
| DE | 196 06 181 | 8/1997 |
| DE | 198 29 805 | 2/2000 |
| EP | 0 514 993 | 11/1992 |
| EP | 0 985 634 | 3/2000 |

OTHER PUBLICATIONS

International Search Report; PCT/US03/00906; M. Desittere; May 13, 2003.

International Search Report; PCT/US03/18069; Sep. 18, 2003; C. Muller.

* cited by examiner

*Primary Examiner*—Steven O. Douglas
(74) *Attorney, Agent, or Firm*—Fish & Richardson P.C.

(57) ABSTRACT

A method for controlling pressure in the vapor or ullage space of an underground storage tank of volatile liquid fuel includes treatment or conditioning of gaseous flow of vapor and air and/or air into the ullage space in a manner to increase the fuel vapor concentration of the gaseous flow toward saturation. A system for controlling pressure in the vapor or ullage space of an underground storage tank of volatile liquid fuel is also described.

12 Claims, 8 Drawing Sheets

VAPOR SPACE PRESSURE CONTROL SYSTEM FOR UNDERGROUND GASOLINE STORAGE TANK

TECHNICAL FIELD

This application claims benefit of U.S. Provisional Application No. 60/347,698, filed Jan. 11, 2002, now abandoned, and U.S. Provisional Application No. 60/364,745, filed Mar. 15, 2002, now abandoned, the complete disclosures of both of which are incorporated herein by reference.

The invention relates to underground gasoline storage tanks, and more particularly to systems for controlling escape of gasoline vapor from such tanks.

BACKGROUND

During refueling of automobiles and other vehicles, liquid gasoline is delivered into the vehicle fuel tank, and a mixture of gasoline (or other fuel) vapor and air is displaced from the tank. To minimize escape of gasoline vapor into the atmosphere, gasoline dispenser nozzles are typically equipped (as often mandated by local environmental protection regulations) with vapor recovery vacuum systems to collect the displaced gasoline vapor, and air, and deliver it back into the ullage (i.e., vapor) space of the underground storage tank ("UST"). Preferably, a 1-to-1 ratio balance is sought between volume of liquid gasoline drawn from the underground storage tank, e.g., during vehicle refueling, to volume of gasoline vapor and air returned into the ullage space by the vapor recovery system. However, due to a combination of factors, including, e.g., differences in temperature, inefficiencies in the vapor recovery system, ingestion of excessive external air, etc., such a balance is difficult to achieve. As a result, some amount of gasoline vapor may be discharged, or air ingested, through the UST pressure/vacuum relief vent valve during any 24-hour period of operation.

This problem has been addressed, in part, by design of ORVR ("onboard refueling vapor recovery") equipped vehicles, in which gasoline vapor collecting in the ullage space of the vehicle tank is recovered onboard the vehicle, making it necessary for the fuel dispensing system to recover only a relatively smaller volume of gasoline vapor and air during refueling, e.g., as compared to non-ORVR vehicles. As a result of the differences between ORVR-equipped and non-ORVR-equipped vehicles, and the fact that both types of vehicles are in regular use, fuel dispensing systems must be designed to detect and accommodate different vapor recovery requirements.

One such fuel dispensing system employs the Healy 800 Nozzle, from Healy Systems, Inc., of Hudson, N.H., assignee of the present application, which is embodied in my earlier U.S. Pat. No. 6,095,204, issued Aug. 1, 2000, the complete disclosure of which is incorporated herein by reference. However, during ongoing field-testing of the Healy 800 Nozzle for purposes of addressing a need to prevent return of too much air when refueling ORVR-equipped vehicles, a troubling phenomenon has been uncovered. A feature of the Healy 800 Nozzle is that it reduces the volume of air returned to the underground storage tank to approximately 25% of the liquid volume dispensed to an ORVR-equipped vehicle. It has been discovered that this can create a problem in a busy service station because ORVR refueling can cause the vapor space pressure to fall to −8.0 inches W.C. ("water column"), at which point the UST pressure/vacuum relief vent valve will open, thus introducing air into the UST. For example, calculations show that less than 600 gallons of gasoline dispensed to ORVR-equipped vehicles can reduce the UST pressure by +8.0 inches W.C. when the ullage space is 20,000 gallons. Additional fueling of ORVR-equipped vehicles beyond that point will then result in a one-to-one relationship of air returned to the UST versus liquid gasoline dispensed, as the Healy 800 Nozzle will continue to return air at a 25% rate while the pressure/vacuum relief vent valve will continue to reopen to allow inward air flow equal to 75% of the liquid gasoline dispensed. Later, when sales activity slows down in the evening and refueling of ORVR-equipped vehicles drops off, the large quantity of air previously ingested will promote evaporation of liquid gasoline into the air in the ullage space, as the enclosed system of gas and liquid moves toward an equilibrium of hydrocarbon concentration in the ullage space with the volume of liquid gasoline. The increasing concentration of gasoline vapor will cause the pressure in the UST to rise, potentially to a positive pressure of +3.0 inches W.C., which will cause the pressure/vacuum relief vent valve to reopen, releasing gasoline vapor into the environment. The problem is not apparent for service stations pumping an average of less than about 150,000 gallons per month; however, it can be very pronounced for larger sites, e.g., those that pump an average over about 500,000 gallons per month.

SUMMARY

According to one aspect of the invention, a method for controlling pressure in a vapor or ullage space of an underground storage tank of volatile liquid fuel comprises the steps of: removing liquid fuel from the underground storage tank for delivery into a vehicle fuel tank; delivering into the ullage space of the underground storage tank, to replace the volume of liquid fuel removed, a gaseous flow comprising fuel vapor and air displaced from the fuel tank by delivery of the fuel and/or air; and treating the gaseous flow into the ullage space to increase the concentration of fuel vapor in the gaseous flow toward saturation.

Preferred embodiments of this aspect of the invention may include one or more of the following features. The method comprises the step of causing the gaseous flow to pass through a gaseous flow conditioning apparatus defining at least one fog chamber into which liquid fuel is delivered through mist heads, thereby to increase the concentration of fuel vapor in the gaseous flow passing into the ullage space. The method comprises the steps of causing the gaseous flow to pass through a gaseous flow conditioning apparatus containing a liquid fuel-wetted saturation medium, and causing the gaseous flow to pass in close proximity to surfaces of the liquid fuel-wetted saturation medium. Preferably, the method comprises the further step of causing the gaseous flow to pass within about 1/16 inch, and more preferably to pass within about 0.050 inch, from surfaces of the liquid saturation medium. The method comprises the further step of providing liquid fuel-wetted saturation medium comprising fuel-wetted wire mesh, stacked layers of wire cloth, or multiple panels of solid material, e.g. cloth, with opposed surfaces defining cannels for passage of gaseous flow. The method comprises the steps of entraining the gaseous flow into a stream of liquid fuel for delivery into a volume of liquid fuel, and allowing the gaseous flow to bubble through liquid fuel in the volume to increase the concentration of fuel vapor in the gaseous flow passing into the ullage space. Preferably the method comprises the step of entraining the gaseous flow in a jet of liquid fuel.

According to another aspect of the invention, a system for controlling pressure in the vapor or ullage space of an underground storage tank of volatile liquid fuel comprises means for treatment of a gaseous flow of air and/or vapor and air mixture into the ullage space in a manner to increase the fuel vapor concentration in the gaseous flow toward saturation.

Preferred embodiments of this aspect of the invention may include one or more of the following features. The means for treatment comprises a gaseous flow conditioning apparatus defining at least one fog chamber with mist heads through which liquid fuel is delivered into the fog chamber, the fog chamber defining at least one channel for passage of the gaseous flow therethrough into the ullage space. The means for treatment comprises a gaseous flow conditioning apparatus containing a liquid fuel-wetted saturation medium defining at least one channel for passage of the gaseous flow therethrough into the ullage space. Preferably, the liquid fuel-wetted saturation medium comprises wire mesh, wire cloth, or multiple panels of solid material, e.g. cloth. Preferably, the channel is defined by opposed surfaces spaced apart by about ⅛ inch, thereby to confine passage of the gaseous flow through the channel to pass within about 1/16 inch from an opposed surface. More preferably, the opposed surfaces are spaced apart by about 0.100 inch, thereby to confine passage of the gaseous flow through the channel to pass within about 0.050 inch from an opposed surface.

According to another aspect of the invention, a system for controlling pressure in the vapor or ullage space of an underground storage tank of volatile liquid fuel comprising means for treatment of a gaseous flow of air and/or vapor and air mixture into the ullage space in a manner to increase the fuel vapor concentration in the gaseous flow toward saturation, the means for treatment comprising means for release of the gaseous flow to bubble through a volume of liquid fuel while passing into the ullage space.

The gaseous flow may thus be treated or conditioned, e.g., by passing it through a liquid fuel mist chamber or through a fuel-wetted mesh, or by causing the gaseous flow to maintain extended flowing contact with liquid-gasoline-wetted surfaces, or by placing the gaseous flow in extended, close proximity or contact with liquid gasoline, e.g., by entraining the gaseous flow with a flow of liquid gasoline and/or by bubbling the gaseous flow through a body of liquid gasoline, e.g. in a liquid reservoir or in the UST itself. Controls may be provided, e.g., to actuate delivery of liquid fuel to the conditioning apparatus when gaseous flow is detected, and/or to ensure that the vacuum/pressure relief valve is not opened for flow of air until a flow of liquid fuel to the conditioning apparatus is confirmed. These and other embodiments of the invention are also described in my U.S. Provisional Application No. 60/387,458, filed Jun. 10, 2002, now abandoned, my U.S. Provisional Application No. 60/408,949, filed Sep. 5, 2002, now abandoned, and my U.S. Provisional Application No. 60/428,018, filed Nov. 21, 2002, now abandoned, the complete disclosures of all of which are incorporated herein by reference.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 6 is a similar side section view of another embodiment of a gaseous flow conditioning apparatus of the invention for treating a gaseous flow of air and/or an air and vapor mixture returning or ingested into the ullage space of an underground gasoline storage tank, while

Like reference symbols in the various drawings indicate like elements.

DETAILED DESCRIPTION

Figure 1:
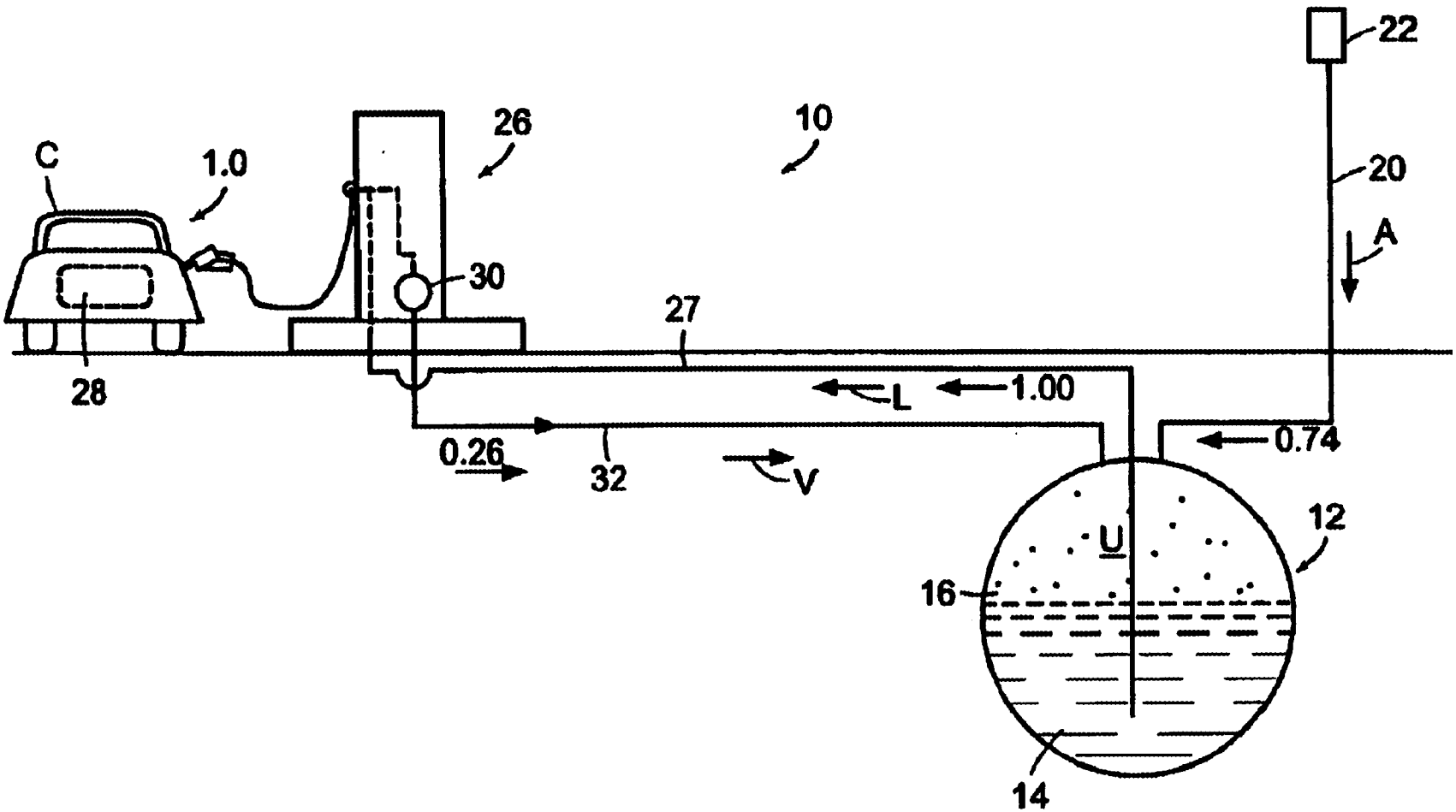
FIG. 1 is a somewhat diagrammatic representation of a typical fuel storage and delivery system.

Referring to FIG. 1, in a typical fuel storage and delivery system 10, e.g., at a gasoline fueling station, an underground storage tank 12 contains a volume of volatile liquid fuel 14, e.g. gasoline, and a volume of a saturated or semi-saturated mixture of gaseous fuel vapor and/or air 16 in a vapor or ullage space, U, above the liquid fuel. The ullage space is connected to the atmosphere via conduit 20, controlled by a UST pressure/vacuum relief vent valve 22, which typically is set to open at −8.0 inches W.C. to permit intake of air into the ullage space and to open at +3.0 inches W.C. to permit release of gaseous vapor from the ullage space.

During refueling of a vehicle, C, as liquid fuel, L, is delivered via conduit 27 from the UST 12 into the vehicle tank 28, fuel vapor displaced from the vehicle tank by the liquid fuel is recovered (typically in a mixture with air) by vacuum drawn by pump 30 in the fuel dispenser 26 and returned to the ullage space, U, via conduit 32. If the vehicle, C, is an ORVR-equipped vehicle, the vacuum return is set at a relatively lower volume ratio of air ingested to liquid removed for delivery into the vehicle tank, e.g., at a volume ratio of about 0.26 to 1.00 (air to liquid).

Figure 2:
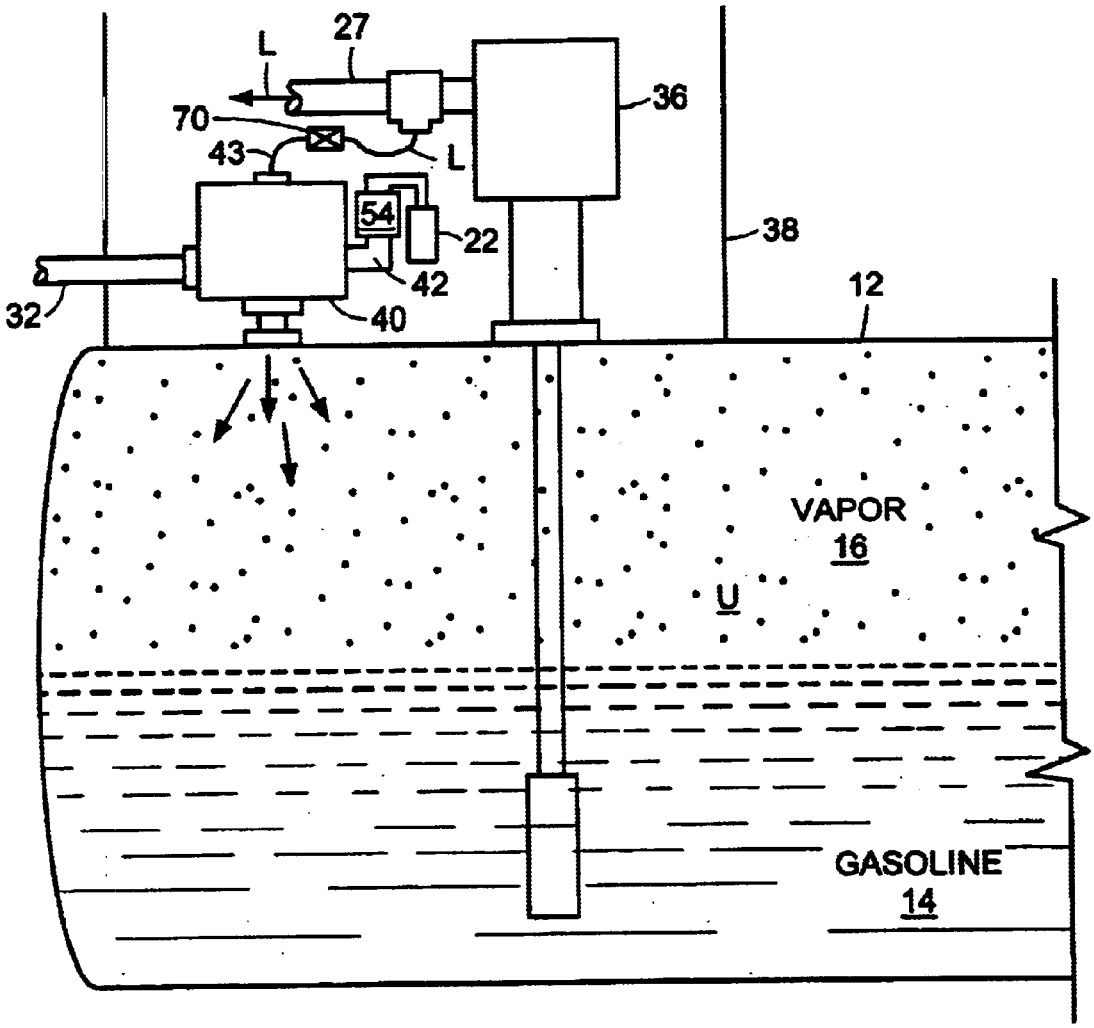
FIG. 2 is a somewhat diagrammatic representation of an underground storage tank equipped with a system for controlling pressure in the vapor space of an underground gasoline storage tank in accordance with the present invention.

Referring to FIG. 2, the underground storage tank 12 is shown in more detail, with a submerged turbine pump (STP) 36 positioned below grade in a sump 38 for delivering liquid gasoline (arrow, L) from the UST. Positioned adjacent the STP in the sump is a gaseous flow conditioning apparatus 40 of the invention for raising the hydrocarbon concentration of vapor and air return/air intake to be returned to the ullage space, U, of the UST 12. In particular, gaseous flows of vapor and air, V, returned from the fuel dispenser 26 (FIG. 1) and air, A, ingested from the atmosphere when the vacuum relief valve 22 opens to relieve pressure in the ullage space, U, at a level between 0 inches W.C. and −8.0 inches W.C., are delivered, via conduits 32, 42, respectively, to flow through the gaseous flow conditioning apparatus 40, several different embodiments of which will be described below.

Figure 3:
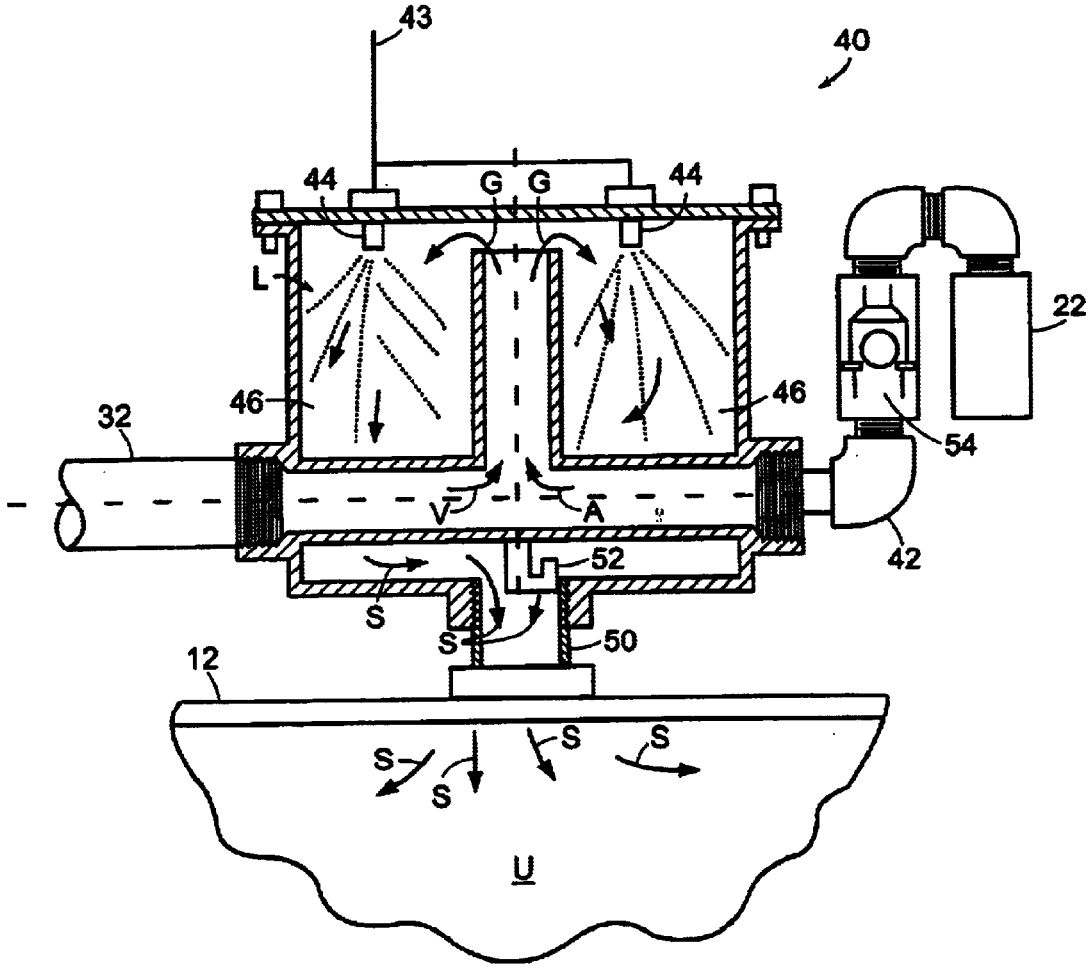
FIG. 3 is a side section view of one embodiment of a gaseous flow conditioning apparatus of the invention for treating a flow of air and/or an air and vapor mixture returning or ingested into the ullage space of an underground gasoline storage tank.

For example, in FIG. 3, liquid fuel, L, from the STP 36 is delivered via conduit 43 at 30 psi through a plurality of mini-mist heads 44 (e.g., two such heads are shown) to create fog chambers 46 that serve to increase the gasoline vapor level of the returning vapor and air, V, and ingested air, A, in a gaseous flow, G, toward the ullage or vapor space, U, of the UST 12, e.g. to saturation. The incoming gaseous flow, G, of vapor and/or air thus is brought to or toward full hydrocarbon saturation in the fog chambers 46 before flowing (arrows, S), via conduit 50, into the ullage space, U, thereby to reduce or eliminate any substantial increase in vapor pressure within the ullage space, due to evaporation of gasoline into a vapor and air mixture delivered into the vapor space at a relatively lower level of hydrocarbon concentration, i.e. much below saturation.

A liquid drain trap 52 in conduit 50 serves to drain liquid gasoline from the low point of the vapor return line to the UST. An aluminum float ball check valve 54 restricts flow of liquid gasoline toward the vent relief valve 22 in case of tank overfilling.

Figure 4:
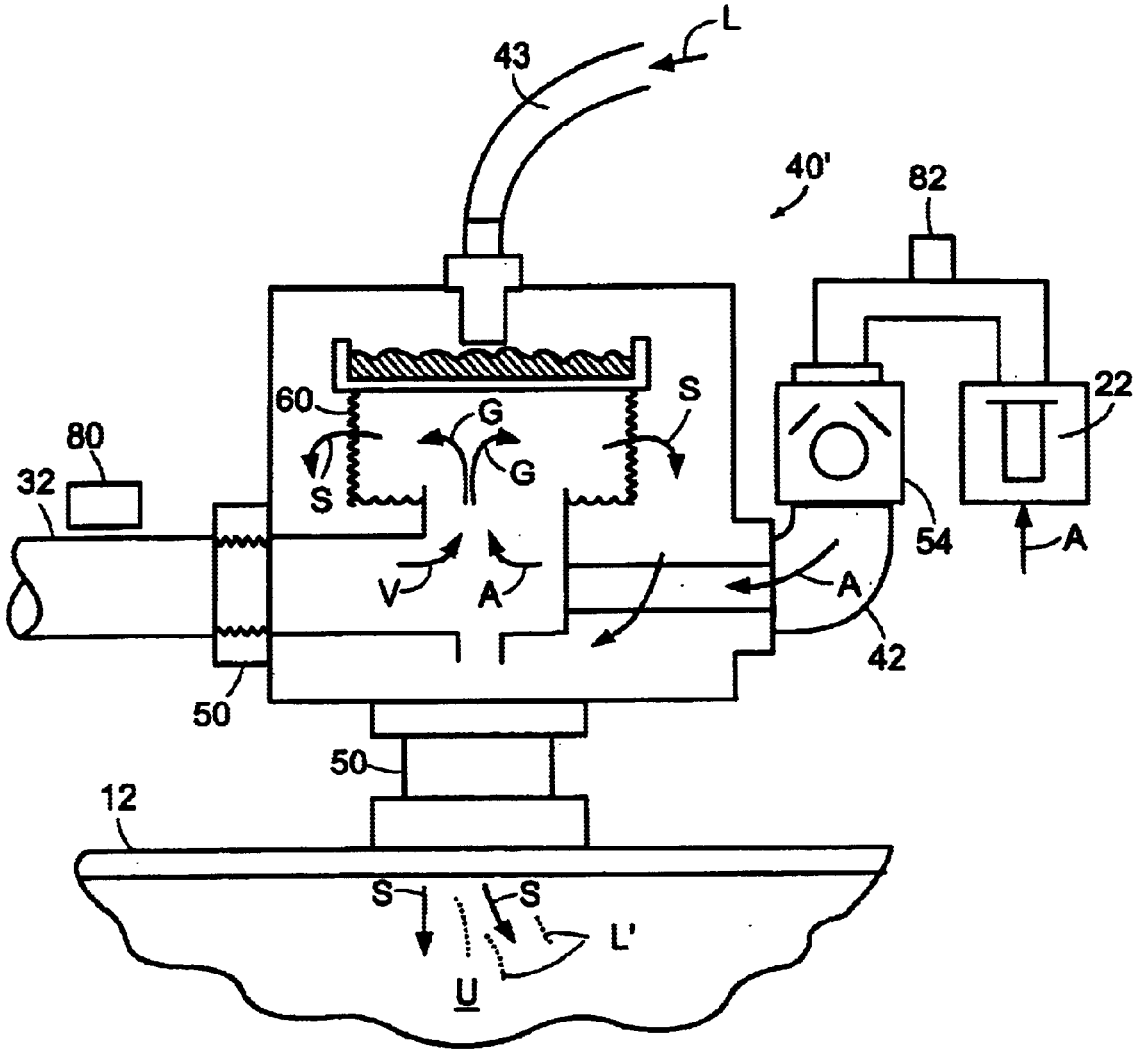
FIG. 4 is a similar side section view of another embodiment of a gaseous flow conditioning apparatus of the invention for treating a flow of air and/or an air and vapor mixture returning or ingested into the ullage space of an underground gasoline storage tank.

Referring to FIG. 4, in a gaseous flow conditioning apparatus 40' of another embodiment of the invention, for treatment of vapor and air return/air intake, liquid gasoline, L, flowing via conduit 43 from the STP 36, is applied to a liquid fuel-wetted saturation medium 60 consisting of, e.g., a fuel-wetted wire mesh or stacked layers of wire cloth through which the gaseous flow, G, of returning vapor and air and/or ingested air (V and A, respectively) is caused to flow to become saturated, S, before entering the ullage space, U, along with excess liquid gasoline, L'.

Figure 5:
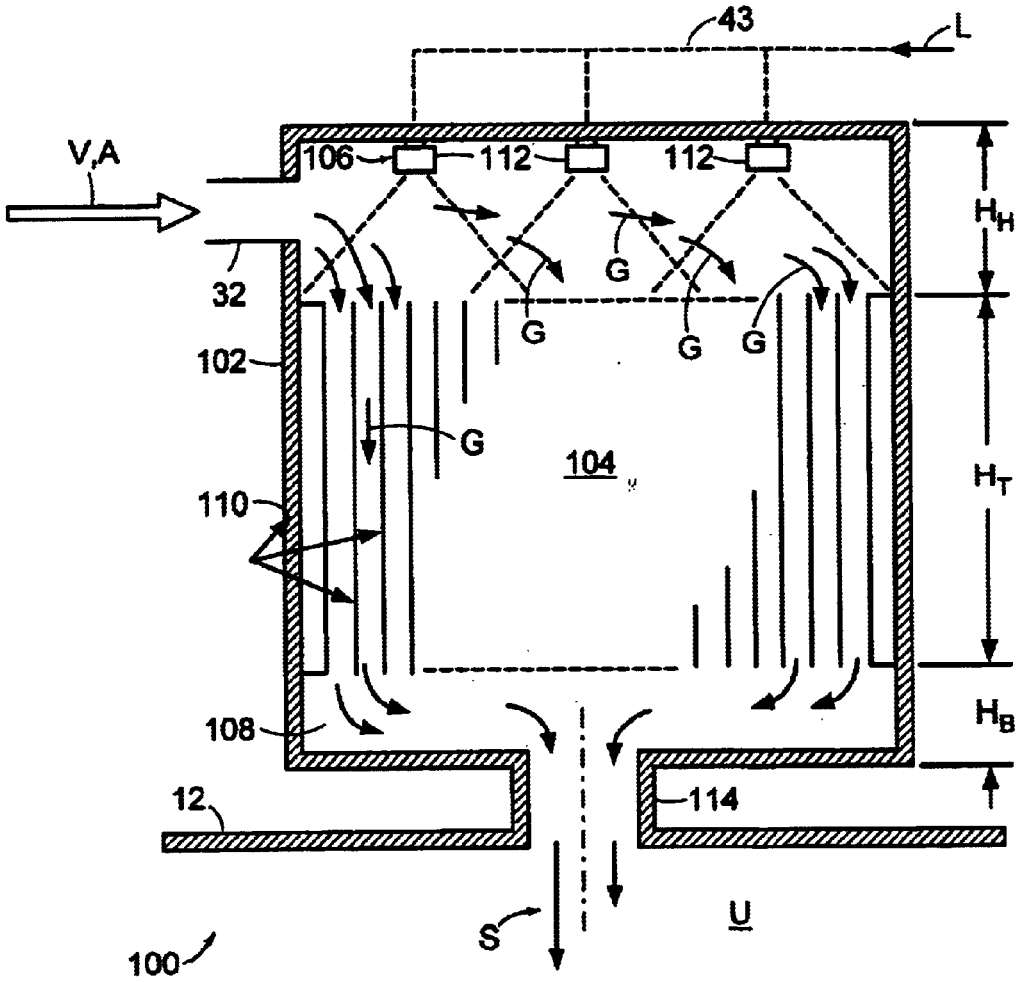
FIG. 5 is a similar side section view of yet another embodiment of a gaseous flow conditioning apparatus of the invention for treating a gaseous flow of air and/or an air and vapor mixture returning or ingested into the ullage space of an underground gasoline storage tank.

Referring next to FIG. 5, a gaseous flow conditioning apparatus 100 of another embodiment of the invention, for conditioning a gaseous flow of returning vapor and air and ingested air, includes a housing 102 defining a volume, e.g., about 12 inches wide by about 12 inches deep, containing a treatment region 104, with an height, $H_T$, e.g. about 12 inches, disposed between a header region 106 of height, $H_H$, e.g., about 3 inches, and a footer region 108 of height, $H_B$, e.g., about 1.5 inches. In the treatment region 104 are disposed panels 110, e.g., cloth or other suitable, e.g. solid, material. For example, in one preferred embodiment, one hundred forty-four cloth panels 110, each approximately 12 inches deep by 12 inches high (about 288 square feet of wetted surface), are placed with opposed surfaces spaced approximately 0.100 inch apart. Liquid gasoline, L, flows via conduit 43 from the STP (36, FIG. 2) to be delivered through non-misting-type spray heads 112 to wet the opposed surfaces of the panels 110. Relief air, A, and returning vapor and air, V, flow, via conduit 32, into the header region 106, to flow between the wetted surfaces of the panels 110. This gaseous flow, G, is thus caused to pass no more than about 0.050 inch maximum distance from a wetted surface, e.g., at a flow rate of about 7.5 gpm, for exposure to the gasoline-wetted surfaces for approximately 60 seconds. The liquid gasoline, L, and hydrocarbon-conditioned gaseous flow, S, continue into the footer region 108 space and, via conduit 114, e.g. a 2-inch diameter pipe, into the vapor space, U, of the UST 12.

Figure 6:
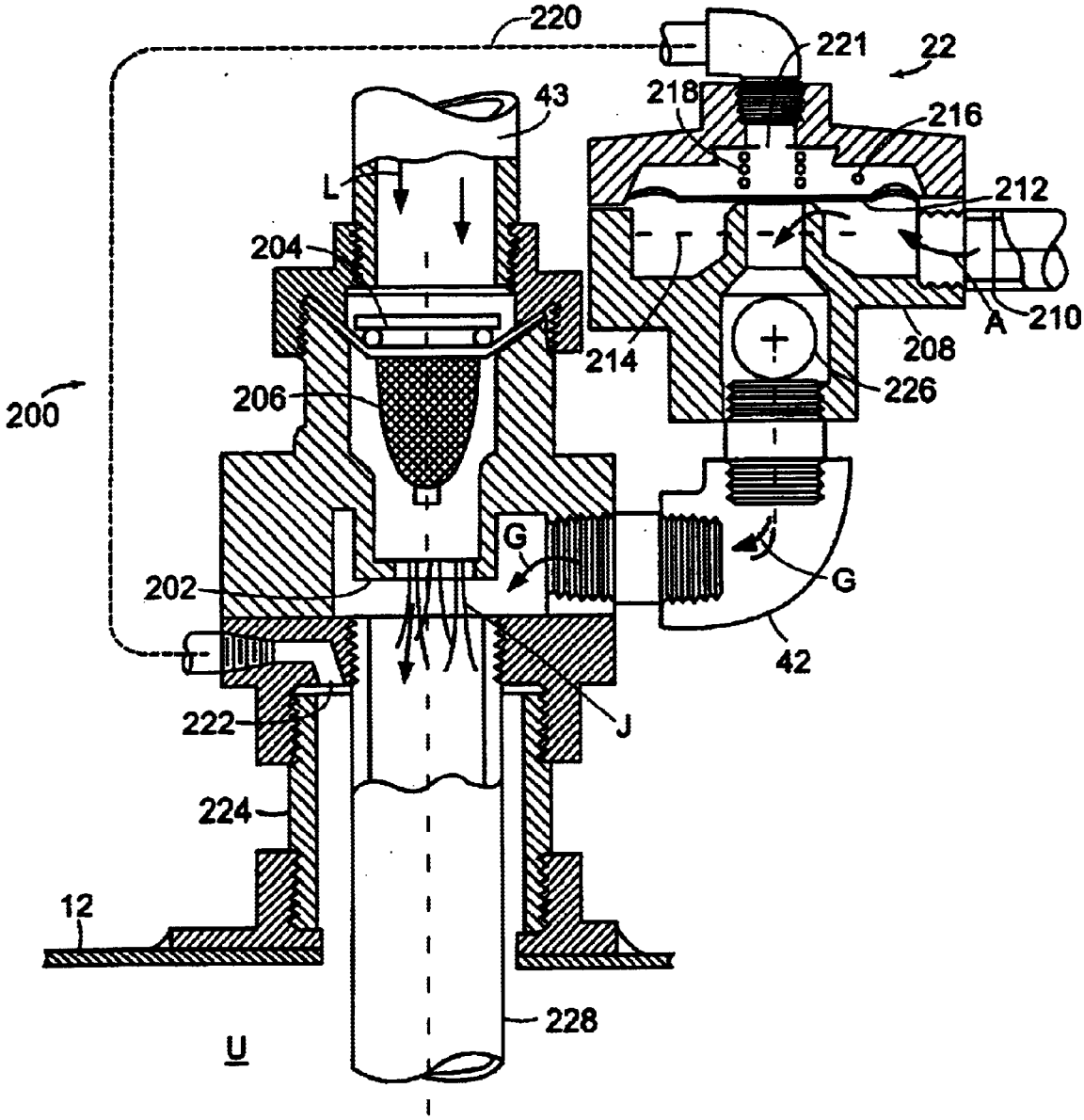
Figure 7:
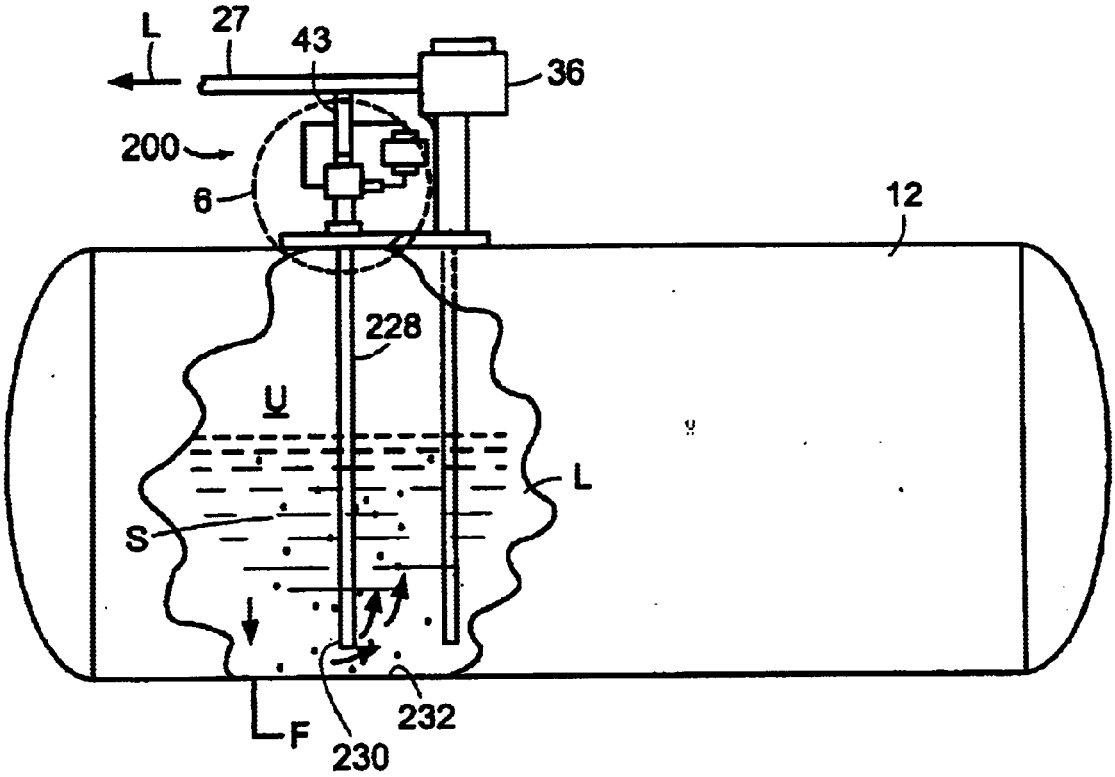
FIG. 7 is somewhat diagrammatic representation of an underground storage tank equipped with a system for controlling pressure in the vapor space of an underground gasoline storage tank in accordance with this embodiment of the present invention.

Referring now to FIGS. 6 and 7, in a gaseous flow conditioning apparatus 200 of another embodiment of the invention, for conditioning of air, A, ingested to relieve a vacuum condition in the ullage space, U, liquid gasoline, L, from the STP (36, FIG. 7) is delivered, e.g. at about 25 to 30 psi, via conduit 43, to a gasoline jet outlet 202. In the conduit approaching the outlet, a check valve 204 and strainer 206 [depicted in the drawing in reverse orientation] are provided to resist flow of liquid gasoline toward the STP in case of tank overfills. Air, A, enters through inlet 210 to UST vacuum relief valve regulator 22, e.g., a diaphragm valve consisting of a housing 208 defining a volume within which is mounted a flexible diaphragm 212 that divides the volume into a first chamber 214 and a second chamber 216. The diaphragm 212 moves between a first position, to resist flow through the valve regulator 22, e.g., ingestion of air, A, into the conduit 42 to the conditioning apparatus 200 or release of vapor, and a second position, to allow flow or ingestion of air, A, through the regulator valve 22 in response to differential of pressure between the first and second chambers, 214, 216, respectively. A spring 218 biases the diaphragm 212 towards its first position (shown), resisting flow. Typically, the UST vacuum relief regulator valve 22 is configured to open for ingestion of air when pressure in the ullage space, U, of the UST (12) reaches a vacuum condition of about −8.0 inch W.C., and to open for release of vapor when pressure in the ullage space, U, reaches about +3.0 inches W.C. When the regulator valve 22 is closed, the first chamber 214 is maintained at atmospheric pressure (0 inches W.C.) through the inlet port 210. The second chamber 216 is maintained in communication with the ullage space, U, of the UST (12) via conduit 220 between port 221 to the second chamber 216 to the regulator valve 22 and port 222 opening into conduit 224. The spring 218 is configured to permit the regulator valve 22 to open for ingestion of air, A, when pressure communicated from the ullage space, U, to the second chamber 216 decreases to about −1.0 inch W.C. The returning vapor is not treated by this embodiment.

A ball check valve 226 in conduit 42 also resists flow of liquid gasoline, L, toward the UST vacuum relief valve regulator 22, e.g., the due to tank overfills.

For conditioning of the gaseous flow, G (here, ingested air, A), liquid gasoline, L, flows through the jet outlet 202 to forms jets, J, of liquid gasoline, and the air, A, is drawn via conduit 42 into the jets, J, of liquid gasoline. The air, A, is thus entrained with the liquid gasoline, L, to flow through a mixing tube 228, e.g., a 1-inch inner diameter pipe, that extends downward into the volume of liquid gasoline, L, in the UST (12, FIG. 7). At the open end 230 of the mixing tube 228, spaced from the bottom surface 232 of the tank 12 by a distance, F, e.g. about 4 to 6 inches, the air, A, is released into the volume of liquid gasoline, L, within the UST, where it rises as bubbles, S, into the UST vapor space, U. The gaseous flow of air within the liquid gasoline in the mixing tube 228 and in the UST serves to condition the air, raising its hydrocarbon vapor concentration to, or at least toward, saturation.

Figure 8:
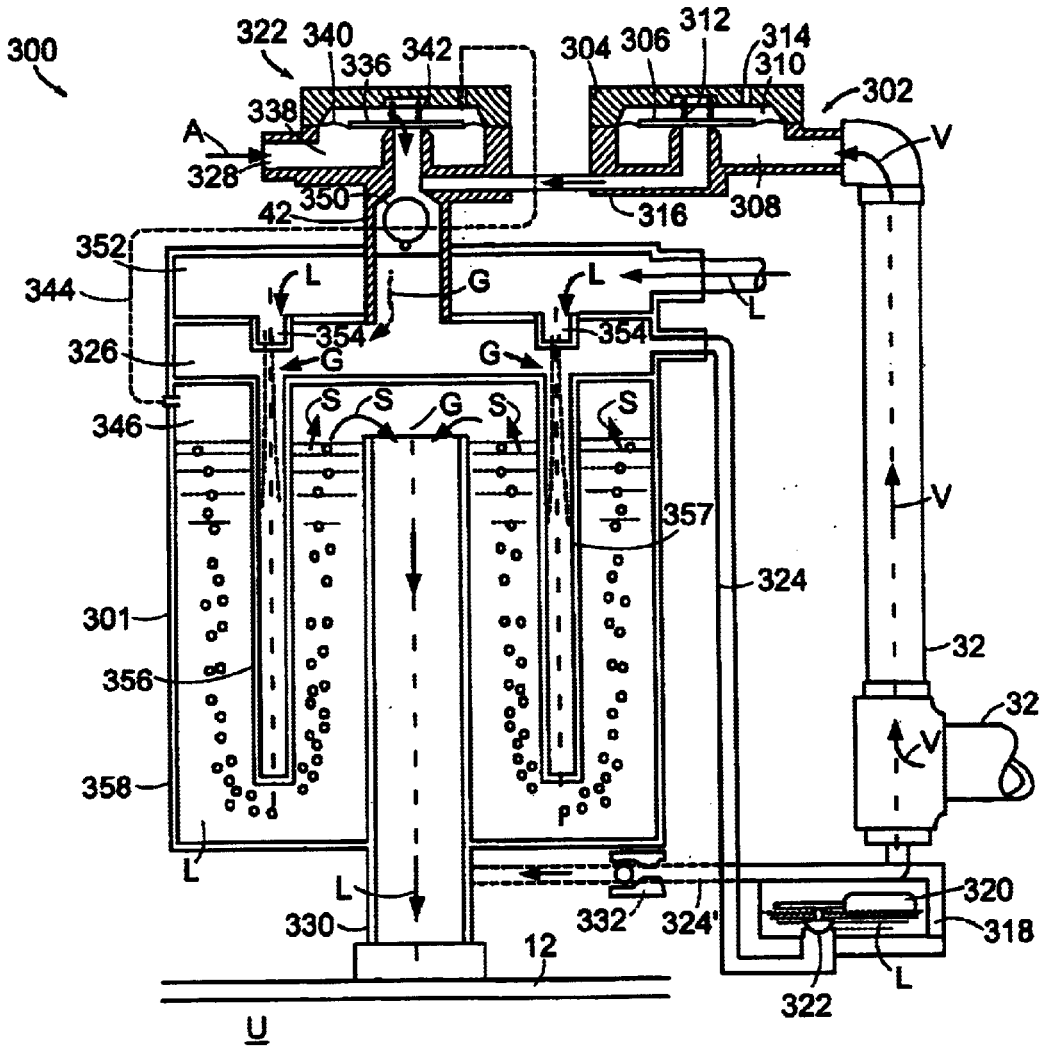
FIG. 8 is a similar side section view of another embodiment of a gaseous flow conditioning apparatus of the invention for treating a gaseous flow of air and/or an air and vapor mixture returning or ingested into the ullage space of an underground gasoline storage tank.

Referring next to FIG. 8, in a gaseous flow conditioning apparatus 300 of another embodiment of the invention, as in the embodiment of FIGS. 6 and 7, the gaseous flow, G (here, returning vapor and air, V, and ingested air, A), is entrained with a flow stream of liquid gasoline, L, to flow into and bubble through a body of liquid gasoline, L (here, in a reservoir contained by a conditioning housing 301), thereby to increase the hydrocarbon concentration of the gaseous flow, G, into the vapor space, U, of the UST.

In particular, returning vapor and air, V, flows through conduit 32 to vapor return pressure regulator 302, e.g., a diaphragm valve consisting of a housing 304 defining a volume within which is mounted a flexible diaphragm 306 that divides the volume into a first chamber 308 and a second chamber 310. The diaphragm 306 moves between a first position, to resist flow through the pressure regulator 302 into the conditioning apparatus 300, and a second position, to allow flow of returning vapor and air, V, through the pressure regulator 302, in response to differential of pressure between the first and second chambers, 308, 310, respectively. A spring 312 biases the diaphragm 306 towards its first position (shown), resisting flow. The second chamber 310 is maintained at atmospheric pressure (0 inches W.C.) through atmospheric bleed port 314. The vapor return pressure regulator 302 is typically configured to open to permit flow of returning vapor and air, V, through the first chamber 308 when pressure in the first chamber 308 rises to about +0.5 inch W.C. The returning vapor and air, V, then flows via conduit 316 into conduit 42. Liquid gasoline, L, entrained in or condensing from the vapor return, V, in conduit 32 is collected in a liquid trap 318 controlled by float 320, opening a valve 322. In the embodiment shown, liquid gasoline released from the trap 318 is drawn by vacuum through conduit 324 into a low pressure region 326 defined of the conditioning apparatus housing 328, as described more fully below. (Alternatively, the liquid gasoline, L, from the trap 318 may be drawn directly via a conduit 324' (dashed line) into conduit 330 carrying overflow of liquid gasoline, L, and the conditioned gaseous flow, S, to the UST 12 and ullage space, U, respectively, again as described more fully below. A check valve 332 in conduit 324' resists flow of liquid gasoline toward the vapor return conduit 32, e.g., in case of tank overfills.)

Air, A, at atmospheric pressure (0 inches W.C.) flows into the conditioning apparatus 300 through inlet 328 to UST vacuum relief valve 322, e.g., a diaphragm valve, consisting of a housing 334 defining a volume within which is mounted a flexible diaphragm 336 that divides the volume into a first chamber 338 and a second chamber 340. The position of the diaphragm 336 between a first position, to resist ingestion of air, A, through the relief valve 322, and a second position, to permit such flow, is determined by differential of pressure between the first and second chambers, 338, 340, respectively. A spring 342 biases the diaphragm 336 towards its first position (shown), resisting flow. The first chamber 338, through which air, A, is ingested when the relief valve 322 is open, is typically at atmospheric pressure, i.e. at 0 inches W.C., while the second chamber 340 is maintained at the pressure of the ullage space, U, by communication via conduit 344 between the second chamber 340 and the conditioning tank vapor space 346, which in turn is in communication with the ullage space, U, via liquid and vapor flow conduit 330. The relief valve 322 is configured to open for ingestion of air, A, when pressure in the ullage space, U, of the UST (12) decreases to about −0.75 inch W.C. When the relief valve 322 opens, air, A, combines with returning vapor and air, V, in a gaseous flow, G, through conduit 42.

The returning vapor and air, V, and ingested air, A, in a gaseous flow, G travel into the low pressure region 326 of the conditioning housing 301. Liquid gasoline, L, from the STP (36, FIG. 2), delivered into an upper flow space 352 at 24 psi, streams, via outlets, 354, through the low pressure region 326, entraining the gaseous flow, G, of vapor and air (and any liquid gasoline drawn from the trap 318), into mixing tubes 356, 357 that extend downward into the body of liquid gasoline, L, in the reservoir 358 of conditioning housing 301. (The streaming flow of liquid gasoline, L, through the low pressure region 326 creates the vacuum pressure condition of about −20.0 inches to about −60.0 inches W.C.) The gaseous flow, G, of vapor and air exits from the lower ends of the mixing tubes 356, 357 to rises as bubbles, S, up through the volume of liquid gasoline, L, in the reservoir 358, and into the conditioning tank vapor space 346. The gaseous flow, S, now conditioned to a relatively higher concentration of hydrocarbon, flows from the conditioning tank vapor space 346 through the overflow pipe 330, with the liquid gasoline, L, into the ullage space, U, of the UST (12).

A float ball valve 350 in conduit 42 resists flow of liquid gasoline, L, toward the UST vacuum relief valve 22, e.g. in the case of tank overfills.

A number of embodiments of the invention have been described. Nevertheless, it will be understood that various modifications may be made without departing from the spirit and scope of the invention. For example, referring again to FIGS. 2, 3 and 4, system controls may include a pressure sensor 70 (FIG. 2) for confirming gasoline flow to saturation elements 44 (FIGS. 2 and 3), 60 (FIG. 4) before the pressure/vacuum relief vent valve 22 is permitted to open. An airflow sensor 80, e.g. in conduit 42, and/or a vapor flow sensor 82, e.g., in conduit 20, may be provided to trigger flow of gasoline, L, in conduit 43, to the saturation elements 44, 60 when returning or ingested gaseous flow is detected. Accordingly, other embodiments are within the scope of the following claims.

What is claimed is:

1. A method for controlling pressure in a vapor or ullage space of an underground storage tank of volatile liquid fuel, the method comprising the steps of:

removing liquid fuel from the underground storage tank for delivery into a vehicle fuel tank;

delivering into the ullage space of the underground storage tank, to replace the volume of liquid fuel removed, a gaseous flow comprising at least one of:

(a) fuel vapor and air displaced from the fuel tank by delivery of the fuel; and (b) air; and treating the gaseous flow into the ullage space in a manner to increase the concentration of fuel vapor in the gaseous flow toward saturation by causing the gaseous flow to pass through a gaseous flow conditioning apparatus containing a liquid fuel-wetted saturation medium, and causing the gaseous flow to pass in close proximity to surfaces of the liquid fuel-wetted saturation medium.

2. The method of claim 1 comprising the further step of causing the gaseous flow to pass within about 1/16 inch from surfaces of the liquid saturation medium.

3. The method of claim 2 comprising the further step of causing the gaseous flow to pass within about 0.050 inch from surfaces of the liquid saturation medium.

4. The method of claim 1, claim 2 or claim 3 comprising the step of providing liquid fuel-wetted saturation medium comprising fuel-wetted wire mesh.

5. The method of claim 1, claim 2 or claim 3 comprising the step of providing liquid fuel-wetted saturation medium comprising stacked layers of wire cloth.

6. The method of claim 1, claim 2 or claim 3 comprising the step of providing liquid fuel-wetted saturation medium comprising multiple panels of solid material with opposed surfaces defining cannels for passage of gaseous flow.

7. The method of claim 6 comprising the step of providing multiple panels of solid material comprising cloth.

8. A system for controlling pressure in the vapor or ullage space of an underground storage tank of volatile liquid fuel comprising means for treatment of a gaseous flow of air and/or vapor and air mixture into the ullage space in a manner to increase the fuel vapor concentration in the gaseous flow toward saturation, said means for treatment comprising a gaseous flow conditioning apparatus containing a liquid fuel-wetted saturation medium defining at least one channel for passage of the gaseous flow therethrough into the ullage space.

9. The system of claim 8, wherein the liquid fuel-wetted saturation medium comprises multiple panels of solid material.

10. The system of claim 9, wherein the solid material comprises cloth.

11. The system of claim 8, 9 or 10, wherein the at least one channel is defined by opposed surfaces spaced apart by about ⅛ inch, thereby to confine passage of the gaseous flow through the channel to pass within about 1/16 inch from an opposed surface.

12. The system of claim 11, wherein the opposed surfaces are spaced apart by about 0.100 inch, thereby to confine passage of the gaseous flow through the channel to pass within about 0.050 inch from an opposed surface.

* * * * *